US011124209B2

(12) United States Patent
Halowell et al.

(10) Patent No.: US 11,124,209 B2
(45) Date of Patent: Sep. 21, 2021

(54) DETERMINING LOSS OF COMMUNICATION BETWEEN RAIL VEHICLES

(71) Applicant: Westinghouse Air Brake Technologies Corporation, Wilmerding, PA (US)

(72) Inventors: John E. Halowell, Montgomery Village, MD (US); Padam Dhoj Swar, Clarksburg, MD (US); Sathya Vagheeswar Venkatasubramanian, Pittsburgh, PA (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 460 days.

(21) Appl. No.: 16/234,866

(22) Filed: Dec. 28, 2018

(65) Prior Publication Data

US 2020/0207388 A1 Jul. 2, 2020

(51) Int. Cl.
*B61L 15/00* (2006.01)
*B61L 25/02* (2006.01)

(52) U.S. Cl.
CPC ..... *B61L 15/0081* (2013.01); *B61L 15/0027* (2013.01); *B61L 15/0054* (2013.01); *B61L 25/025* (2013.01)

(58) Field of Classification Search
CPC ..... B61L 15/0081; B61L 15/0027; B61L 15/0054; B61L 25/025
See application file for complete search history.

(56) References Cited

U.S. PATENT DOCUMENTS 5,016,840 A * 5/1991 Bezos ..... B60L 15/32 246/167 R
5,681,015 A * 10/1997 Kull ..... B61L 15/0054 246/187 C
5,902,341 A * 5/1999 Wilson ..... B61L 15/0072 342/357.34
6,144,900 A * 11/2000 Ali ..... B61L 15/0027 246/122 R
6,322,025 B1 * 11/2001 Colbert ..... B61L 15/0027 246/167 R
10,858,019 B2 * 12/2020 Toth ..... B61L 23/00
2002/0027495 A1 * 3/2002 Darby, Jr. ..... H04L 1/188 340/298

(Continued)

*Primary Examiner* — Jason C Smith
(74) *Attorney, Agent, or Firm* — Christopher R. Carroll; The Small Patent Law Group LLC

(57) ABSTRACT

A system for determining a location of a rail vehicle based on an radio frequency (RF) signal that includes at least one processor programmed or configured to determine that a first RF communication signal transmitted by a head of train (HOT) unit of a plurality of rail vehicles is received by an end of train (EOT) unit of the plurality of rail vehicles, determine whether a second RF communication signal transmitted by the HOT unit is received by the EOT unit during a time interval after a time at which the first RF communication signal was determined to be received by the EOT unit, and determine one or more locations of the plurality of rail vehicles based on determining that the second RF communication signal transmitted by the HOT unit is not received by the EOT unit during the time interval. A method and computer program product are also disclosed.

20 Claims, 8 Drawing Sheets

(56) References Cited

U.S. PATENT DOCUMENTS

| | | | | |
|---|---|---|---|---|
| 2014/0277859 | A1* | 9/2014 | Morris | B61L 25/02 701/19 |
| 2016/0096537 | A1* | 4/2016 | Bartek | H04W 4/40 246/124 |
| 2019/0144020 | A1* | 5/2019 | Toth | B61L 23/00 246/167 R |
| 2019/0168728 | A1* | 6/2019 | Venkatasubramanian | B61C 17/12 |
| 2019/0289522 | A1* | 9/2019 | Yang | H04W 36/00837 |
| 2019/0366998 | A1* | 12/2019 | Bolte | B60T 13/665 |
| 2020/0122756 | A1* | 4/2020 | Swar | B61L 15/0018 |
| 2020/0122757 | A1* | 4/2020 | Abrosimov | B61L 15/0072 |
| 2020/0172133 | A1* | 6/2020 | Abrosimov | B61L 15/0027 |
| 2020/0172134 | A1* | 6/2020 | Kernwein | G06K 9/00791 |
| 2020/0207387 | A1* | 7/2020 | Abrosimov | B61L 15/0072 |
| 2020/0207388 | A1* | 7/2020 | Halowell | B61L 15/0054 |
| 2020/0300600 | A1* | 9/2020 | Wallner | H04B 3/60 |

* cited by examiner

600

| Date/Time | Alert Type | Address | Lat/Long | Firmware | Battery | EOT Status |
|---|---|---|---|---|---|---|
| 07/05/2016 00:28 CDT | Position Report | KS | 38.6572800 -96.9507750 | 06.9.6.000 | 13.6 | Air mode |
| 07/05/2016 01:30 CDT | RF Loss Report | KS | 38.4323230 -96.9751500 | 06.9.6.000 | 13.6 | Air mode |
| 07/05/2016 02:31 CDT | RF Loss Report | KS | 37.9991400 -97.1260100 | 06.9.6.000 | 13.6 | Air mode |
| 07/05/2016 03:32 CDT | RF Loss Report | Wichita, KS | 37.7402650 -97.3170800 | 06.9.6.000 | 13.6 | Air mode |
| 07/05/2016 04:31 CDT | RF Loss Report | Wichita, KS | 37.7402650 -97.3171200 | 06.9.6.000 | 13.6 | Battery mode |
| 07/05/2016 10:34 CDT | Position Report | Wichita, KS | 37.7331100 -97.3197860 | 06.9.6.000 | 13.6 | Sleeping and tracking mode |

FIG. 6A

602

| Date/Time | Alert Type | Address | Lat/Long | Firmware |
|---|---|---|---|---|
| 07/05/2016 00:28 CDT | Position Report | KS | 38.6572800 -96.9507750 | 06.9.6.000 |
| 07/05/2016 01:30 CDT | RF Loss Report | KS | 38.4323230 -96.9751500 | 06.9.6.000 |
| 07/05/2016 02:31 CDT | RF Loss Report | KS | 37.9991400 -97.1260100 | 06.9.6.000 |
| 07/05/2016 03:32 CDT | RF Loss Report | Wichita, KS | 37.7402650 -97.3170800 | 06.9.6.000 |
| 07/05/2016 04:31 CDT | RF Loss Report | Wichita, KS | 37.7402650 -97.3171200 | 06.9.6.000 |
| 07/05/2016 10:34 CDT | Position Report | Wichita, KS | 37.7331100 -97.3197860 | 06.9.6.000 |

FIG. 6B

DETERMINING LOSS OF COMMUNICATION BETWEEN RAIL VEHICLES

BACKGROUND

1. Field

This disclosure relates generally to systems, devices, products, apparatus, and methods that are used for intra-train communication systems, in one particular embodiment, to a system, product, and method for determining loss of communication between rail vehicles.

2. Technical Considerations

An intra-train communication system may include a radio frequency (RF) (e.g., wireless) communication system for communicating RF signals associated with the command and control response time of a plurality of rail vehicles (e.g., a train). In some instances, an intra-train communication system may include an end of train (EOT) unit positioned on a trailing rail vehicle and a head of train (HOT) unit (e.g., a locomotive cab unit (LCU)) positioned on a lead rail vehicle.

The EOT unit may monitor operating conditions of the plurality of rail vehicles, including air pressure in the brake line, battery condition, marker light condition, motion, and/or emergency valve status, and transmit information associated with the operating conditions to the HOT unit so that informed command and control decisions may be made.

However, communication between the EOT unit and the HOT unit may be lost while the plurality of rail vehicles is traveling along a railway. For example, a communication connection between the EOT unit and the HOT unit may be lost, so that information transmitted by the EOT unit to the HOT unit is not received by the HOT unit, and vice versa. In some instances, the communication connection may be lost based on conditions surrounding a railway as the plurality of rail vehicles travel on the railway. For example, the plurality of rail vehicles may travel through a tunnel, travel by a structure that blocks the communication connection, travel over terrain that prevents the communication connection (e.g., traveling over or around a mountain), and/or the like. Without the communication connection between the EOT unit and the HOT unit, informed command and control decisions may not be made based on information associated with the operating conditions of the plurality of rail vehicles. In addition, the EOT unit and/or the HOT unit may be required to adjust a communication scheme between the EOT unit and the HOT unit. For example, additional messages may be communicated between the EOT unit and the HOT unit based on the loss of the communication connection, information may be communicated via a less reliable communication scheme than the communication connection, and/or the like.

SUMMARY

Accordingly, systems, devices, products, apparatus, and/or methods for determining loss of a communication between rail vehicles are disclosed that overcome some or all of the deficiencies of the prior art.

According to another non-limiting embodiment, provided is a system for determining loss of a communication between rail vehicles. The system includes at least one processor programmed or configured to determine that a first radio frequency (RF) communication signal transmitted by a head of train (HOT) unit of a plurality of rail vehicles is received by an end of train (EOT) unit of the plurality of rail vehicles; determine whether a second RF communication signal transmitted by the HOT unit is received by the EOT unit during a time interval after a time at which the first RF communication signal was determined to be received by the EOT unit; and determine one or more locations of the plurality of rail vehicles based on determining that the second RF communication signal transmitted by the HOT unit is not received by the EOT unit during the time interval.

According to a non-limiting embodiment, provided is a method for determining loss of a communication between rail vehicles. The method includes determining, with at least one processor of an EOT unit, that a first radio frequency (RF) communication signal transmitted by a head of train (HOT) unit of a plurality of rail vehicles is received by the EOT unit of the plurality of rail vehicles; determining, with at least one processor of the EOT unit, whether a second RF communication signal transmitted by the HOT unit is received by the EOT unit during a time interval after the first RF communication signal was received by the EOT unit; and determining, with at least one processor of the EOT unit, one or more locations of the plurality of rail vehicles based on determining that the second RF communication signal transmitted by the HOT unit is not received by the EOT unit during the time interval.

According to a further non-limiting embodiment, provided is a computer program product for determining loss of a communication between rail vehicles. The computer program product comprises at least one non-transitory computer-readable medium including one or more instructions that, when executed by at least one processor, cause the at least one processor to determine that a first radio frequency (RF) communication signal transmitted by a head of train (HOT) unit of a plurality of rail vehicles is received by an end of train (EOT) unit of the plurality of rail vehicles; determine whether a second RF communication signal transmitted by the HOT unit is received by the EOT unit during a time interval after a time at which the first RF communication signal was determined to be received by the EOT unit; and determine one or more locations of the plurality of rail vehicles based on determining that the second RF communication signal transmitted by the HOT unit is not received by the EOT unit during the time interval.

Further embodiments or aspects are set forth in the following numbered clauses:

Clause 1: A system for determining loss of a communication between rail vehicles, comprising: at least one processor programmed or configured to: determine that a first radio frequency (RF) communication signal transmitted by a head of train (HOT) unit of a plurality of rail vehicles is received by an end of train (EOT) unit of the plurality of rail vehicles; determine whether a second RF communication signal transmitted by the HOT unit is received by the EOT unit during a time interval after a time at which the first RF communication signal was determined to be received by the EOT unit; and determine one or more locations of the plurality of rail vehicles based on determining that the second RF communication signal transmitted by the HOT unit is not received by the EOT unit during the time interval.

Clause 2: The system of clause 1, wherein the time interval has a range between 0.6 seconds to four minutes.

Clause 3: The system of clauses 1 or 2, wherein the at least one processor is a component of the EOT unit.

Clause 4: The system of any of clauses 1-3, wherein the at least one processor is further programmed or configured to: determine the time at which the first RF communication signal was determined to be received by the EOT unit; initiate a time counter after the time at which the first RF communication signal was determined to be received by the EOT unit; and stop the time counter at a time at which a third RF communication signal was determined to be received by the EOT unit.

Clause 5: The system of any of clauses 1-4, wherein, when determining the one or more locations of the plurality of rail vehicles, the at least one processor is programmed or configured to: determine location coordinates of the one or more locations of the plurality of rail vehicles, wherein the one or more locations of the plurality of rail vehicles include a plurality of locations on a railway that the plurality of rail vehicles traveled between initiating the time counter and stopping the time counter.

Clause 6: The system of any of clauses 1-5, wherein, when determining the one or more locations of the plurality of rail vehicles, the at least one processor is programmed or configured to: determine location coordinates of the one or more locations of the plurality of rail vehicles, wherein the one or more locations of the plurality of rail vehicles include one or more locations on a railway that the plurality of rail vehicles traveled during the time interval.

Clause 7: The system of any of clauses 1-6, wherein the at least one processor is further programmed or configured to: determine location data associated with the one or more locations of the plurality of rail vehicles based on determining the one or more locations; and store the location data associated with the one or more locations of the plurality of rail vehicles in a data structure.

Clause 8: A method for determining loss of a communication between rail vehicles comprising: determining, with at least one processor of an end of train (EOT) unit, that a first radio frequency (RF) communication signal transmitted by a head of train (HOT) unit of a plurality of rail vehicles is received by the EOT unit of the plurality of rail vehicles; determining, with at least one processor of the EOT unit, whether a second RF communication signal transmitted by the HOT unit is received by the EOT unit during a time interval after the first RF communication signal was received by the EOT unit; and determining, with at least one processor of the EOT unit, one or more locations of the plurality of rail vehicles based on determining that the second RF communication signal transmitted by the HOT unit is not received by the EOT unit during the time interval.

Clause 9: The method of clause 8, wherein the time interval has a range between 0.6 seconds to four minutes.

Clause 10: The method of clauses 8 or 9, further comprising: determining a time at which the first RF communication signal was received by the EOT unit; initiating a time counter after the time at which the first RF communication signal was determined to be received by the EOT unit; and stopping the time counter at a time at which a third RF communication signal was determined to be received by the EOT unit.

Clause 11: The method of any of clauses 8-10, wherein determining the one or more locations of the plurality of rail vehicles comprises: determining location coordinates of the one or more locations of the plurality of rail vehicles, wherein the one or more locations of the plurality of rail vehicles include a plurality of locations on a railway that the plurality of rail vehicles traveled between initiating the time counter and stopping the time counter.

Clause 12: The method of any of clauses 8-11, wherein determining the one or more locations of the plurality of rail vehicles, the at least one processor is programmed or configured to: determine location coordinates of the one or more locations of the plurality of rail vehicles, wherein the one or more locations of the plurality of rail vehicles include one or more locations on a railway that the plurality of rail vehicles traveled during the time interval.

Clause 13: The method of any of clauses 8-12, further comprising: determining location data associated with the one or more locations of the plurality of rail vehicles based on determining the one or more locations; and storing the location data associated with the one or more locations of the plurality of rail vehicles in a data structure.

Clause 14: The method of any of clauses 8-13, further comprising: transmitting location data associated with the one or more locations of the plurality of rail vehicles to a back office system based on determining that the second RF communication signal transmitted by the HOT unit is not received by the EOT unit during the time interval.

Clause 15: A computer program product for determining loss of a communication between rail vehicles, the computer program product comprising at least one non-transitory computer-readable medium including one or more instructions that, when executed by at least one processor, cause the at least one processor to: determine that a first radio frequency (RF) communication signal transmitted by a head of train (HOT) unit of a plurality of rail vehicles is received by an end of train (EOT) unit of the plurality of rail vehicles; determine whether a second RF communication signal transmitted by the HOT unit is received by the EOT unit during a time interval after a time at which the first RF communication signal was determined to be received by the EOT unit; and determine one or more locations of the plurality of rail vehicles based on determining that the second RF communication signal transmitted by the HOT unit is not received by the EOT unit during the time interval.

Clause 16: The computer program product of clause 15, wherein the time interval has a range between 0.6 seconds to four minutes.

Clause 17: The computer program product of clauses 15 or 16, wherein the one or more instructions further cause the at least one processor to: determine the time at which the first RF communication signal was determined to be received by the EOT unit; initiate a time counter after the time at which the first RF communication signal was determined to be received by the EOT unit; and stop the time counter at a time at which a third RF communication signal was determined to be received by the EOT unit.

Clause 18: The computer program product of any of clauses 15-17, wherein the one or more instructions that cause the at least one processor to determine the one or more locations of the plurality of rail vehicles, cause the at least one processor to: determine location coordinates of the one or more locations of the plurality of rail vehicles, wherein the one or more locations of the plurality of rail vehicles include a plurality of locations on a railway that the plurality of rail vehicles traveled between initiating the time counter and stopping the time counter.

Clause 19: The computer program product of any of clauses 15-18, wherein the one or more instructions that cause the at least one processor to determine the one or more locations of the plurality of rail vehicles, cause the at least one processor to: determine location coordinates of the one or more locations of the plurality of rail vehicles, wherein the one or more locations of the plurality of rail vehicles include one or more locations on a railway that the plurality of rail vehicles traveled during the time interval.

Clause 20: The computer program product of any of clauses 15-19, wherein the one or more instructions further cause the at least one processor to: determine location data associated with the one or more locations of the plurality of rail vehicles based on determining the one or more locations; and transmit the location data associated with the one or more locations of the plurality of rail vehicles based on determining location data associated with the one or more locations of the plurality of rail vehicles.

BRIEF DESCRIPTION OF THE DRAWINGS

FIGS. 6A and 6B are diagrams of a non-limiting embodiment of data structures including data associated with one or more rail vehicles assigned to location data associated with a plurality of locations of the one or more rail vehicles.

DETAILED DESCRIPTION

Figure 1:
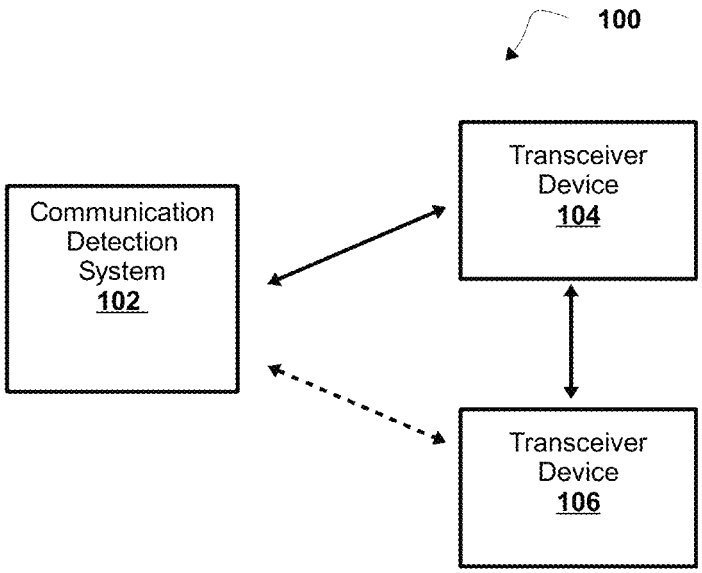
FIG. 1 is a diagram of a non-limiting embodiment of an environment in which systems, devices, products, apparatus, and/or methods, described herein, may be implemented.

The following detailed description of non-limiting embodiments refers to the accompanying drawings. The same reference numbers in different drawings may identify the same or similar elements.

For purposes of the description hereinafter, the terms "end," "upper," "lower," "right," "left," "vertical," "horizontal," "top," "bottom," "lateral," "longitudinal," and derivatives thereof shall relate to the disclosure as it is oriented in the drawing figures. However, it is to be understood that the disclosure may assume various alternative variations and step sequences, except where expressly specified to the contrary. It is also to be understood that the specific devices and processes illustrated in the attached drawings, and described in the following specification, are simply exemplary embodiments or aspects of the disclosure. Hence, specific dimensions and other physical characteristics related to the embodiments or aspects of the embodiments disclosed herein are not to be considered as limiting unless otherwise indicated.

No aspect, component, element, structure, act, step, function, instruction, and/or the like used herein should be construed as critical or essential unless explicitly described as such. Also, as used herein, the articles "a" and "an" are intended to include one or more items, and may be used interchangeably with "one or more" and "at least one." Furthermore, as used herein, the term "set" is intended to include one or more items (e.g., related items, unrelated items, a combination of related and unrelated items, etc.) and may be used interchangeably with "one or more" or "at least one." Where only one item is intended, the term "one" or similar language is used. Also, as used herein, the terms "has," "have," "having," or the like are intended to be open-ended terms. Further, the phrase "based on" is intended to mean "based at least partially on" unless explicitly stated otherwise.

As used herein, the terms "communication" and "communicate" may refer to the reception, receipt, transmission, transfer, provision, and/or the like of information (e.g., data, signals, messages, instructions, commands, and/or the like). For one unit (e.g., a device, a system, a component of a device or system, combinations thereof, and/or the like) to be in communication with another unit means that the one unit is able to directly or indirectly receive information from and/or transmit information to the other unit. This may refer to a direct or indirect connection that is wired and/or wireless in nature. Additionally, two units may be in communication with each other even though the information transmitted may be modified, processed, relayed, and/or routed between the first and second unit. For example, a first unit may be in communication with a second unit even though the first unit passively receives information and does not actively transmit information to the second unit. As another example, a first unit may be in communication with a second unit if at least one intermediary unit (e.g., a third unit located between the first unit and the second unit) processes information received from the first unit and communicates the processed information to the second unit. In some non-limiting embodiments, a message may refer to a network packet (e.g., a data packet and/or the like) that includes data. It will be appreciated that numerous other arrangements are possible.

As disclosed herein, in some non-limiting embodiments, a system for determining loss of a communication between rail vehicles may determine that a first radio frequency (RF) communication signal transmitted by a head of train (HOT) unit or an end of train (EOT) unit of a plurality of rail vehicles is received by the EOT unit or the HOT unit of the plurality of rail vehicles, determine whether a second RF communication signal transmitted by the HOT unit or EOT unit is received by the EOT unit or the HOT unit during a time interval after a time at which the first RF communication signal was determined to be received by the EOT unit or HOT unit; and determine one or more locations of the plurality of rail vehicles based on determining that the second RF communication signal transmitted by the HOT unit or the EOT unit is not received by the EOT unit or HOT unit during the time interval.

In this way, the system may be able to determine a location where the communication connection is lost between the EOT unit and the HOT unit and additional communication infrastructure may be installed to allow informed command and control decisions to be made for the plurality of rail vehicles. In addition, the EOT unit and/or the HOT unit may be able to forego adjusting a communication scheme between the EOT unit and the HOT unit based on determining one or more locations where an RF communication signal is not received. For example, the EOT unit or the HOT unit may determine that the plurality of rail vehicles are approaching one or more locations where the communication connection is lost between the EOT unit and the HOT unit and the EOT unit and/or the HOT unit may forego adjusting the communication scheme based on determining that the plurality of rail vehicles will travel to a location where an RF communication signal is received by the EOT unit or the HOT unit.

Referring now to FIG. 1, FIG. 1 is a diagram of a non-limiting embodiment of environment 100 in which systems, devices, products, apparatus, and/or methods, described herein, may be implemented. As shown in FIG. 1, environment 100 includes communication detection system 102, transceiver device 104 and transceiver device 106. The systems and/or devices of environment 100 may interconnect via wired connections, wireless connections, or a combination of wired and wireless connections. For example, systems and/or devices of environment 100 may interconnect via one or more wired and/or wireless networks, where the one or more wired and/or wireless networks may include, a bus, a bus network, a local area network (LAN), a wireless LAN (WLAN), a private network, an ad hoc network, an intranet, the Internet, a fiber optic-based network, a cloud computing network, and/or the like, and/or a combination of these or other types of networks. In some non-limiting embodiments, communication detection system 102 may interconnect to transceiver device 104 or transceiver device 106 via a wired connection and transceiver device 104 may interconnect to transceiver device 106, or vice versa, via a wireless connection.

In some non-limiting embodiments, communication detection system 102 may include one or more devices capable of determining whether an RF signal is received (e.g., by a device associated with communication detection system 102, such as a device of communication detection system 102), determining a location of a rail vehicle, and storing data associated with the location of the rail vehicle. For example, communication detection system 102 may include one or more computing devices, such as a server, a group of servers, a computer, and/or the like. In some non-limiting embodiments, communication detection system 102 may include a transceiver device (e.g., transceiver device 104 or transceiver device 106).

In some non-limiting embodiments, transceiver device 104 and/or transceiver device 106 may include a device capable of receiving information and transmitting information. For example, transceiver device 104 may include a transmitter-receiver, a transmitter, a receiver, and/or the like.

The number and arrangement of systems shown in FIG. 1 are provided as an example. There may be additional systems, devices and/or networks, fewer systems, devices, and/or networks, different systems, devices and/or networks, or differently arranged systems, devices, and/or networks than those shown in FIG. 1. Furthermore, two or more systems or devices shown in FIG. 1 may be implemented within a single system or a single device, or a single system or a single device shown in FIG. 1 may be implemented as multiple, distributed systems or devices. Additionally or alternatively, a set of systems or a set of devices (e.g., one or more systems, one or more devices) of environment 100 perform one or more functions described as being performed by another set of systems or another set of devices of environment 100.

Figure 2:
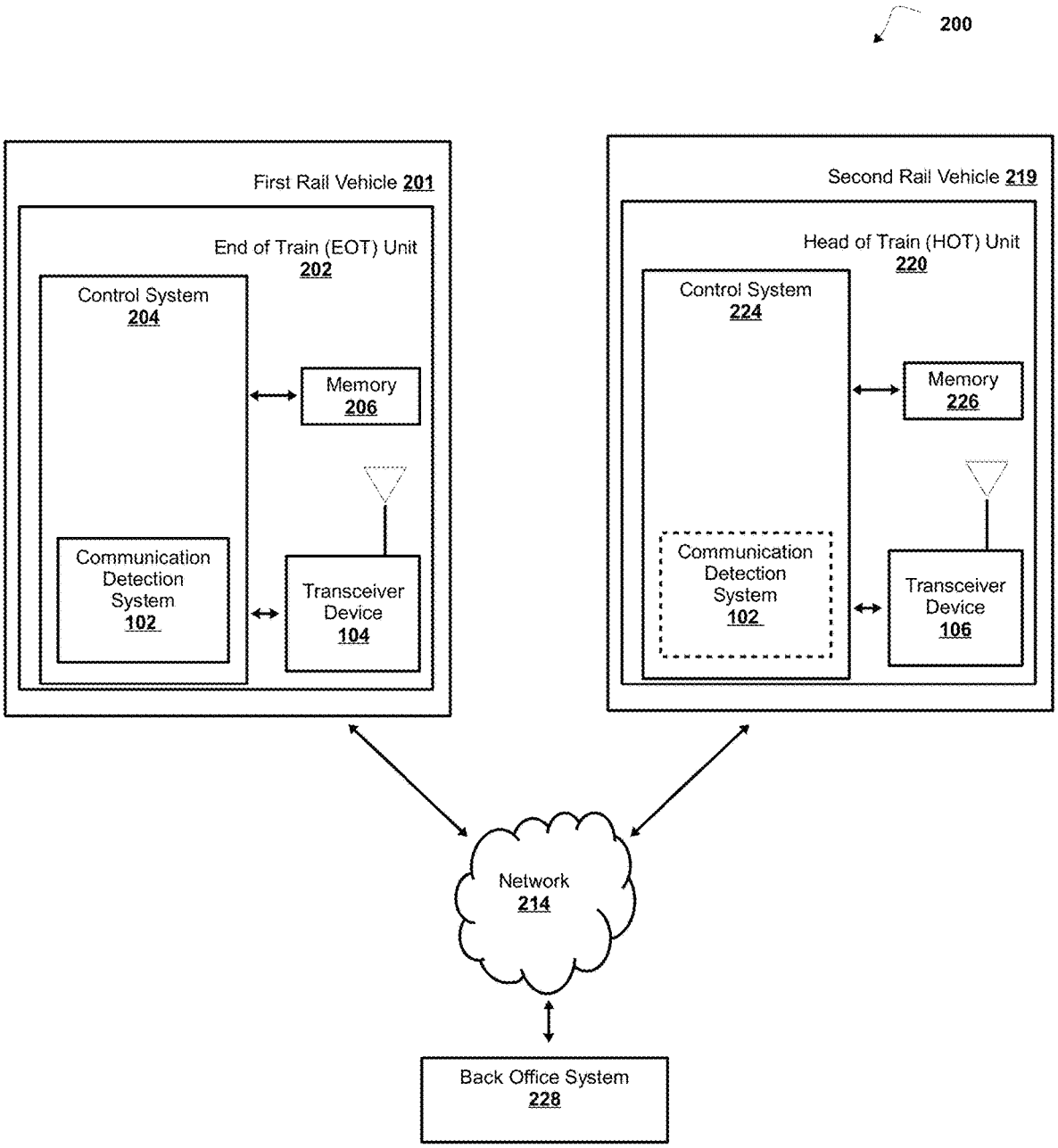
FIG. 2 is a diagram of a non-limiting embodiment of a system for determining loss of a communication signal for a rail vehicle.

Referring now to FIG. 2, FIG. 2 is a diagram of a non-limiting embodiment of rail vehicle system 200 for determining loss of a communication signal for a rail vehicle. As shown in FIG. 2, first rail vehicle 201 may include EOT unit 202 which includes control system 204, memory 206, and transceiver device 104. As further shown in FIG. 2, control system 204 includes communication detection system 102. In some non-limiting embodiments, communication detection system 102 and/or transceiver device 104 may be separate from EOT unit 202. For example, communication detection system 102 may include a server (e.g., that is not part of EOT unit 202) that communicates with EOT unit 202 via a network (e.g., a wireless network). In another example, transceiver device 104 may be a component of first rail vehicle 201 that is separate from EOT unit 202. In some non-limiting embodiments, EOT unit 202 may be positioned on (e.g., attached to, a component of, and/or the like) first rail vehicle 201.

As further shown in FIG. 2, second rail vehicle 219 may include HOT unit 220 which includes control system 224, memory 226, and transceiver device 106. In some non-limiting embodiments, control system 224 may include communication detection system 102. In some non-limiting embodiments, communication detection system 102 and/or transceiver device 106 may be separate from HOT unit 220. For example, communication detection system 102 may include a server (e.g., that is not part of HOT unit 220) that communicates with HOT unit 220 via a network (e.g., a wireless network). In another example, transceiver device 106 may be a component of second rail vehicle 219 that is separate from HOT unit 220. In some non-limiting embodiments, HOT unit 220 may be positioned on second rail vehicle 219.

As further shown in FIG. 2, back office system 228 may communicate with first rail vehicle 201 and/or second rail vehicle 219 via network 214. In some non-limiting embodiments, back office system 228 may include communication detection system 102. In some non-limiting embodiments, back office system 228 may include one or more devices capable of receiving, transmitting, and/or storing data associated with the location of a rail vehicle. For example, back office system 228 may include one or more servers (e.g., one or more back office servers associated with a positive train control (PTC) system).

In some non-limiting embodiments, network 214 may include one or more wired and/or wireless networks. For example, network 214 may include an interoperable train control messaging (ITCM) network, a cellular network (e.g., a long-term evolution (LTE) network, a third generation (3G) network, a fourth generation (4G) network, a code division multiple access (CDMA) network, etc.), a public land mobile network (PLMN), a local area network (LAN), a wide area network (WAN), a metropolitan area network (MAN), a telephone network (e.g., the public switched telephone network (PSTN)), a private network, an ad hoc network, an intranet, the Internet, a fiber optic-based network, a cloud computing network, and/or the like, and/or a combination of these or other types of networks.

In some non-limiting embodiments, control system 204 and/or control system 224 may receive telemetry information (e.g., position information, global positioning system (GPS) position information, location coordinates, etc.) associated with first rail vehicle 201 and/or second rail vehicle 219. For example, control system 204 and/or control system 224 may receive telemetry information associated with first rail vehicle 201 and/or second rail vehicle 219 from a radio transmitter, a satellite-based positioning system satellite (e.g., a GPS satellite, and/or the like), and/or a wayside radio system. In some non-limiting embodiments, control system 204 and/or control system 224 may affect the operation of first rail vehicle 201 and/or second rail vehicle 219 based on the telemetry information. For example, control system 204 and/or control system 224 may cause a brake system of first rail vehicle 201 and/or second rail vehicle 219 to be activated based on the telemetry information.

Figure 3:
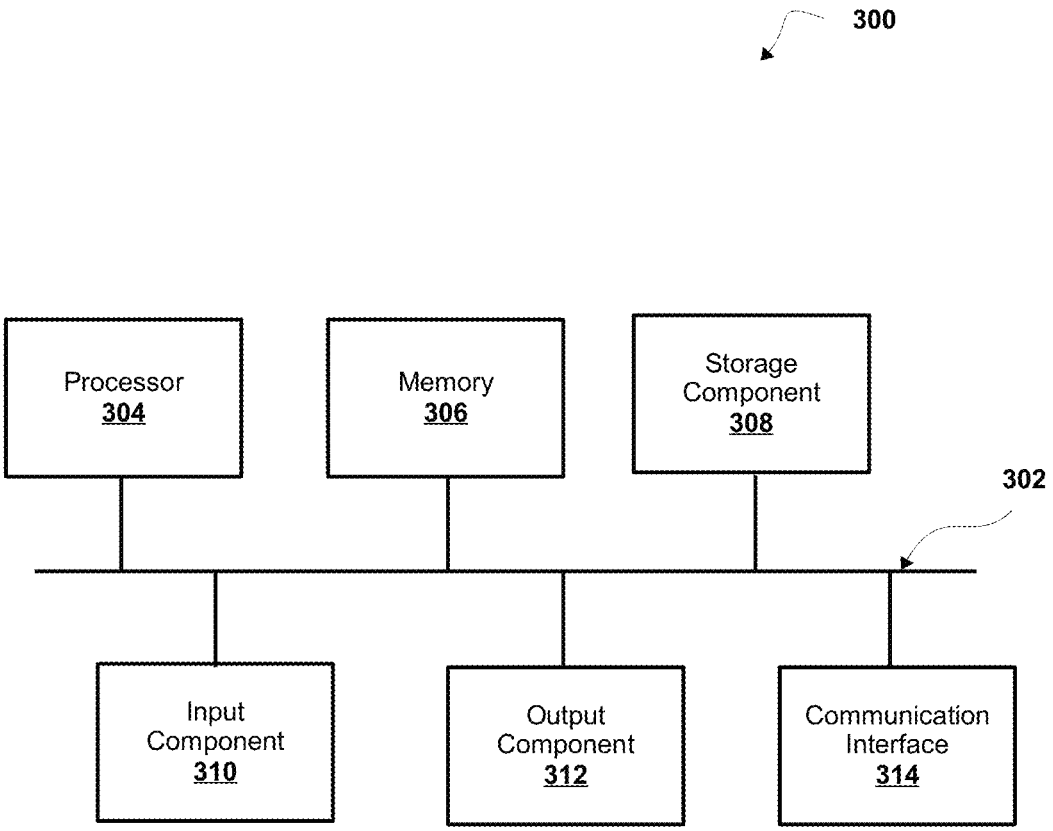
FIG. 3 is a diagram of a non-limiting embodiment of components of one or more devices of FIG. 1 and FIG. 2.

Referring now to FIG. 3, FIG. 3 is a diagram of example components of device 300. In some non-limiting embodiments, device 300 corresponds to one or more devices of communication detection system 102, transceiver device 104, transceiver device 106, one or more devices of control system 204, and/or one or more devices of control system 224. In some non-limiting embodiments, one or more devices of communication detection system 102, one or more devices of control system 204, and/or one or more devices of control system 224 may include at least one device 300 and/or at least one component of device 300. As shown in FIG. 3, device 300 may include bus 302, processor 304, memory 306, storage component 308, input component 310, output component 312, and communication interface 314.

Bus 302 may include a component that permits communication among the components of device 300. In some non-limiting embodiments, processor 304 may be implemented in hardware or a combination of hardware and software. For example, processor 304 may include a processor (e.g., a central processing unit (CPU), a graphics processing unit (GPU), an accelerated processing unit (APU), etc.), a microprocessor, a digital signal processor (DSP), and/or any processing component (e.g., a field-programmable gate array (FPGA), an application-specific integrated circuit (ASIC), etc.) that can be programmed to perform a function. Memory 306 may include a random access memory (RAM), a read only memory (ROM), and/or another type of dynamic or static storage device (e.g., flash memory, magnetic memory, optical memory, etc.) that stores information and/or instructions for use by processor 304.

Storage component 308 may store information and/or software related to the operation and use of device 300. For example, storage component 308 may include a hard disk (e.g., a magnetic disk, an optical disk, a magneto-optic disk, a solid state disk, etc.), a compact disc (CD), a digital versatile disc (DVD), a floppy disk, a cartridge, a magnetic tape, and/or another type of computer-readable medium, along with a corresponding drive.

Input component 310 may include a component that permits device 300 to receive information, such as via user input (e.g., a touch screen display, a keyboard, a keypad, a mouse, a button, a switch, a microphone, etc.). Additionally or alternatively, input component 310 may include a sensor for sensing information (e.g., a GPS component, an accelerometer, a gyroscope, an actuator, etc.). Output component 312 may include a component that provides output information from device 300 (e.g., a display, a speaker, one or more light-emitting diodes (LEDs), etc.).

Communication interface 314 includes a transceiver-like component (e.g., a transceiver, a separate receiver and transmitter, etc.) that enables device 300 to communicate with other devices, such as via a wired connection, a wireless connection, or a combination of wired and wireless connections. Communication interface 314 permits device 300 to receive information from another device and/or provide information to another device. For example, communication interface 314 may include an Ethernet interface, an optical interface, a coaxial interface, an infrared interface, a radio frequency (RF) interface, a universal serial bus (USB) interface, a Wi-Fi interface, a cellular network interface, and/or the like.

In some non-limiting embodiments, device 300 performs one or more processes described herein. In some non-limiting embodiments, device 300 performs these processes based on processor 304 executing software instructions stored by a computer-readable medium, such as memory 306 and/or storage component 308. A computer-readable medium (e.g., a non-transitory computer-readable medium) is defined herein as a non-transitory memory device. A memory device includes memory space located inside of a single physical storage device or memory space spread across multiple physical storage devices.

Software instructions are read into memory 306 and/or storage component 308 from another computer-readable medium or from another device via communication interface 314. When executed, software instructions stored in memory 306 and/or storage component 308 cause processor 304 to perform one or more processes described herein. Additionally or alternatively, hardwired circuitry may be used in place of or in combination with software instructions to perform one or more processes described herein. Thus, embodiments described herein are not limited to any specific combination of hardware circuitry and software.

The number and arrangement of components shown in FIG. 3 are provided as an example. In some non-limiting embodiments, device 300 includes additional components, fewer components, different components, or differently arranged components than those shown in FIG. 3. Additionally or alternatively, a set of components (e.g., one or more components) of device 300 performs one or more functions described as being performed by another set of components of device 300.

Figure 4:
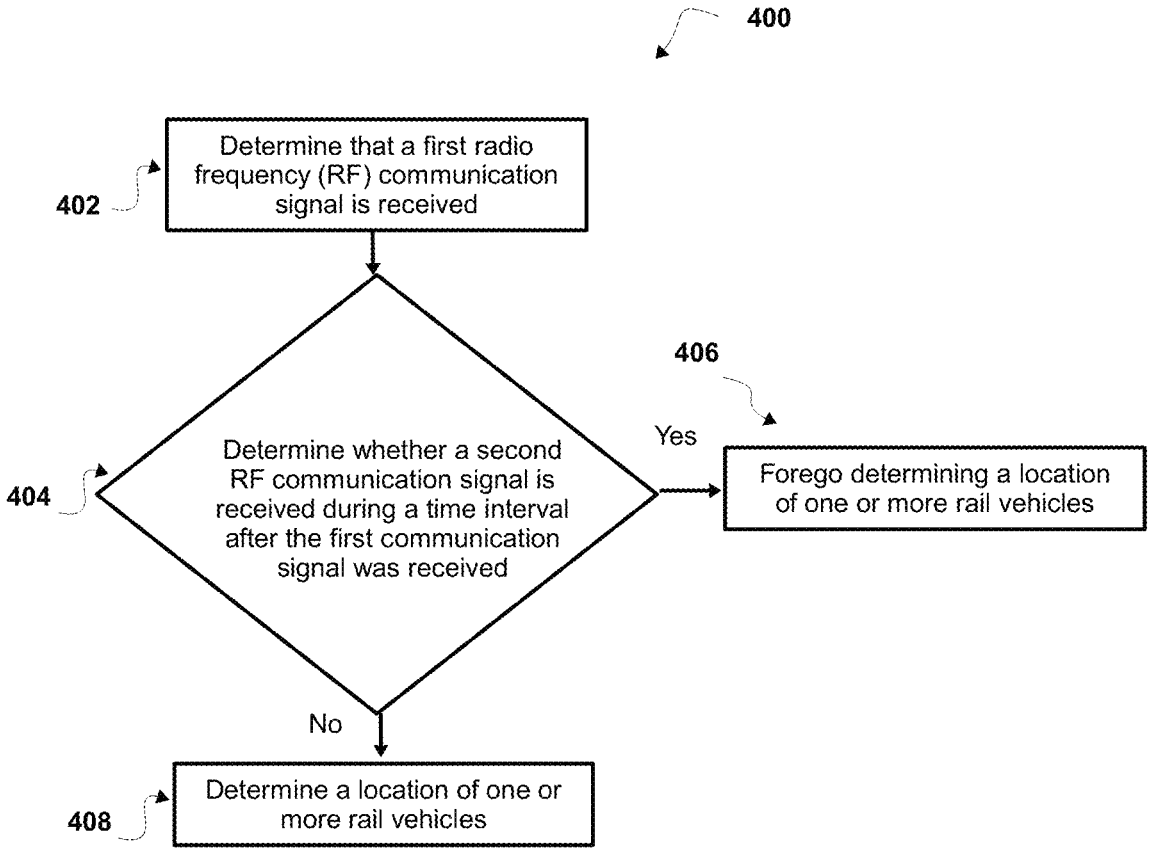
FIG. 4 is a flowchart of a non-limiting embodiment of a process for determining loss of a communication signal for a rail vehicle.

Referring now to FIG. 4, FIG. 4 is a flowchart of a non-limiting embodiment of process 400 for determining loss of a communication signal for a rail vehicle. In some non-limiting embodiments, one or more of the steps of process 400 may be performed (e.g., completely, partially, etc.) by communication detection system 102 (e.g., one or more devices of communication detection system 102). In some non-limiting embodiments, one or more of the steps of process 400 may be performed (e.g., completely, partially, etc.) by another device or a group of devices separate from or including communication detection system 102, such as an additional communication detection systems, one or more components of EOT unit 202, one or more components of HOT unit 220, one or more components of first rail vehicle 201, one or more components of second rail vehicle 219, and/or the like.

As shown in FIG. 4, at step 402, process 400 includes determining that a first RF communication signal is received. For example, communication detection system 102 may determine that the first RF communication signal is received. In some non-limiting embodiments, the first RF communication signal may be an RF communication signal transmitted by transceiver device 104 and/or transceiver device 106 of a plurality of rail vehicles. For example, the first RF communication signal may be transmitted by EOT unit 202 via transceiver device 104 and/or HOT unit 220 via transceiver device 106. In some non-limiting embodiments, the first RF communication signal may be received by EOT unit 202 via transceiver device 104 and/or HOT unit 220 via transceiver device 106.

In some non-limiting embodiments, the first RF communication signal may be an RF communication signal transmitted by a transceiver device (e.g., transceiver device 104 and/or transceiver device 106) according to a communication protocol for communications between rail vehicles, such as a communication protocol specified by the Association of American Railroads (AAR), a communication protocol that is proprietary to a railway company, and/or the like. In some non-limiting embodiments, the RF communication signal may include a message. For example, the RF communication signal may include a poll message (e.g., a polling message, a control-acknowledgment message, and/or the like) according to a communication protocol (e.g., AAR S-9152 protocol) for railway communications. In another example, the RF communication signal may include a communication test message according to a communication protocol for railway communications. In some non-limiting embodiments, the message may include a poll message that has been modified. For example, one or more bits of the poll message may be modified.

In some non-limiting embodiments, communication detection system 102 may determine that the first RF communication signal is received based on an output from transceiver device 104 and/or transceiver device 106. For example, communication detection system 102 may determine that the first RF communication signal is received based on communication detection system 102 receiving the output that includes an indication that the first RF communication signal is received by transceiver device 104 and/or transceiver device 106.

In some non-limiting embodiments, communication detection system 102 may determine that the first RF communication signal is received based on an RF communication connection (e.g., an RF communication connection according to a communication protocol, such as the AAR S-9152 protocol, an RF communication channel, and/or the like) being initiated between HOT unit 220 and EOT unit 202 (e.g., being armed between HOT unit 220 and EOT unit 202, EOT unit 202 is armed to HOT unit 220, and/or the like). For example, communication detection system 102 may determine that the first RF communication signal is received by EOT unit 202 or HOT unit 220 after the RF communication connection is initiated between HOT unit 220 and EOT unit 202.

In some non-limiting embodiments, the RF communication connection may be initiated between HOT unit 220 and EOT unit 202 based on a plurality of RF communication signals communicated between HOT unit 220 (e.g., via transceiver device 106) and EOT unit 202 (e.g., via transceiver device 104) according to a communication protocol. For example, the plurality of RF communication signals may be communicated between HOT unit 220 and EOT unit 202 based on AAR S-9152 protocol.

In such an example, EOT unit 202 may transmit (e.g., via transceiver device 104) an initiation request message (e.g., an arming request message according to AAR S-9152 protocol) for the communication connection. HOT unit 220 may receive the initiation request message and HOT unit 220 may transmit an initiation response message (e.g., a first communications test message according to AAR S-9152 protocol) to EOT unit 202 based on receiving the initiation request message. In some non-limiting embodiments, EOT unit 202 may receive the initiation response message from HOT unit 220 as the first RF communication signal.

In some non-limiting embodiments, EOT unit 202 may receive the initiation response message and EOT unit 202 may transmit an acknowledgment request message to HOT unit 220. HOT unit 220 may receive the acknowledgment request message and HOT unit 220 may transmit an acknowledgment response message (e.g., a second communications test message according to AAR S-9152 protocol) to EOT unit 202 based on receiving the acknowledgment request message. In some non-limiting embodiments, HOT unit 220 may transmit a poll message to EOT unit 202 based on receiving the acknowledgment request message.

In some non-limiting embodiments, EOT unit 202 may receive the acknowledgment response message from HOT unit 220 as the first RF communication signal. For example, EOT unit 202 may receive the acknowledgment response message from HOT unit 220 as the first RF communication signal during initiation of the communication connection.

In some non-limiting embodiments, communication detection system 102 may determine that the first RF communication signal is received based on EOT unit 202 receiving the acknowledgment response message from HOT unit 220 as the first RF communication signal. In some non-limiting embodiments, EOT unit 202 may transmit a poll message to HOT unit 220 before receiving the first RF communication signal from HOT unit 220. For example, EOT unit 202 may transmit the poll message to HOT unit 220 and HOT unit 220 may receive the poll message. In some non-limiting embodiments, HOT unit 220 may transmit a poll response message (e.g., a response message to the poll message from EOT unit 202) as the first RF communication signal (e.g., the acknowledgment response message, the second communications test message according to AAR S-9152 protocol, and/or the like) based on receiving the poll message.

In some non-limiting embodiments, EOT unit 202 may receive the first RF communication signal transmitted by HOT unit 220 and EOT unit 202 may transmit a polling message to HOT unit 220 at a predetermined time interval (e.g., transmit a polling message every 0.6 seconds, transmit a polling message every second, transmit a polling message every six seconds, transmit a polling message every minute, transmit a polling message every two minutes, transmit a polling message every three minutes, transmit a polling message every four minutes, and/or the like). For example, EOT unit 202 may transmit the polling message to HOT unit 220 at the predetermined time interval after receiving the acknowledgment response message from HOT unit 220. In some non-limiting embodiments, EOT unit 202 may transmit the polling message to HOT unit 220 according to a predetermined time interval. Additionally or alternatively, HOT unit 220 may transmit the polling message to EOT unit 202 according to a predetermined time interval.

In some non-limiting embodiments, HOT unit 220 may receive the poll message from EOT unit 202 as the first RF communication signal. For example, after a communication connection is initiated between EOT unit 202 and HOT unit 220, HOT unit 220 may receive the poll message from EOT unit 202 as the first RF communication signal. In some non-limiting embodiments, communication detection system 102 may determine that the first RF communication signal is received when HOT unit 220 receives the poll message from EOT unit 202 as the first RF communication signal.

As further shown in FIG. 4, at step 404, process 400 includes determining whether a second RF communication signal is received during a time interval after the first RF communication signal was received. For example, communication detection system 102 may monitor an RF communication connection between HOT unit 220 and EOT unit 202 to determine whether the second RF communication signal is received. In some non-limiting embodiments, communication detection system 102 may determine whether the second RF communication signal is received based on determining whether the polling message is received during the time interval after the first RF communication signal was received. For example, communication detection system 102 may determine whether the second RF communication signal is received by EOT unit 202 based on determining whether the polling message from HOT unit 220 is received by EOT unit 202 during the time interval after the first RF communication signal was received. Additionally or alternatively, communication detection system 102 may determine whether the second RF communication signal is received by HOT unit 220 based on determining whether the polling message from EOT unit 202 is received by HOT unit 220 during the time interval after the first RF communication signal was received. In some non-limiting embodiments, communication detection system 102 may determine whether the second RF communication signal is received based on determining whether a response message to a poll message is received during the time interval after the first RF communication signal was received. For example, communication detection system 102 may determine whether the second RF communication signal is received by EOT unit 202 based on determining whether the response message from HOT unit 220 to the polling message from EOT unit 202 is received by EOT unit 202 during the time interval. Additionally or alternatively, communication detection system 102 may determine whether the second RF communication signal is received by HOT unit 220 based on determining whether the response message from EOT unit 202 to the polling message from HOT unit 220 is received by HOT unit 220 during the time interval.

In some non-limiting embodiments, communication detection system 102 may determine whether the second RF communication signal is received during the time interval after the first RF communication signal was received based on a state of the RF communication connection between HOT unit 220 and EOT unit 202, a state of HOT unit 220, and/or a state of EOT unit 202. For example, communication detection system 102 may determine whether the second RF communication signal is received based on the RF communication connection between HOT unit 220 and EOT unit 202 being in an initiated state (e.g., HOT unit 220 being armed to EOT unit 202). In another example, communication detection system 102 may determine whether the second RF communication signal is received based on EOT unit 202 and/or HOT unit 220 being in an air run state (e.g., an air run mode where primary power to a brake system is provided by a compressed air source, such as an air compressor) or a battery run state (e.g., a battery run mode where primary power to a brake system is provided by an electrical power source, such as a battery).

In some non-limiting embodiments, communication detection system 102 may determine whether the second RF communication signal is received based on a speed of a plurality of rail vehicles, on which EOT unit 202 and HOT unit 220 are positioned. For example, communication detection system 102 may determine whether the second RF communication signal is received based on the speed of the plurality of rail vehicles satisfying a threshold value of speed (e.g., a threshold value of speed equal to 30 mph). In some non-limiting embodiments, communication detection system 102 may monitor a RF communication connection between HOT unit 220 and EOT unit 202 and determine that the second RF communication signal is or is not received based on the speed of the plurality of rail vehicles being less than the threshold value of speed.

In some non-limiting embodiments, communication detection system 102 may determine whether the second RF communication signal is received by EOT unit 202 during the time interval after the first RF communication signal was received by EOT unit 202. For example, communication detection system 102 may determine whether the second communication signal transmitted by HOT unit 220 is received by EOT unit 202 during the time interval after a time at which the first RF communication signal was determined to be received by EOT unit 202. In some non-limiting embodiments, communication detection system 102 may determine whether the second RF communication signal is received by HOT unit 220 during the time interval after the first RF communication signal was received by HOT unit 220. For example, communication detection system 102 may determine whether the second RF communication signal transmitted by EOT unit 202 is received by HOT unit 220 during the time interval after a time at which the first RF communication signal was determined to be received by HOT unit 220. In some non-limiting embodiments, communication detection system 102 may determine when the first RF communication signal was received. For example, communication detection system 102 may determine a time at which the first RF communication signal was determined to be received by EOT unit 202 or HOT unit 220.

In some non-limiting embodiments, the time interval may be based on a communication protocol for communications between rail vehicles, such as a communication protocol specified by the AAR, a communication protocol that is proprietary to a railway company, and/or the like. For example, the time interval may have a range between two to four minutes.

In some non-limiting embodiments, the second RF communication signal may be an RF communication signal transmitted by a transceiver device (e.g., transceiver device 104 and/or transceiver device 106) according to a communication protocol for communications between rail vehicles. In some non-limiting embodiments, the second RF communication signal may be transmitted according to a communication protocol that is the same as the communication protocol by which the first RF communication signal was transmitted. In some non-limiting embodiments, the RF communication signal may include a message. For example, the RF communication signal may include a poll message (e.g., a polling message, a control-acknowledgment message, and/or the like) according to a communication protocol (e.g., AAR S-9152 protocol) for railway communications. In another example, the RF communication signal may include a communication test message according to a communication protocol for railway communications. In some non-limiting embodiments, the message may include a poll message that has been modified. For example, one or more bits of the poll message may be modified.

In some non-limiting embodiments, communication detection system 102 may determine that the second RF communication signal is received based on an output from transceiver device 104 and/or transceiver device 106. For example, communication detection system 102 may determine that the second RF communication signal is received based on communication detection system 102 receiving the output that includes an indication that the second RF communication signal is received by transceiver device 104 and/or transceiver device 106. In some non-limiting embodiments, communication detection system 102 may determine that the second RF communication signal is not received based on failing to receive an output from transceiver device 104 and/or transceiver device 106. For example, communication detection system 102 may determine that the second RF communication signal is received based on communication detection system 102 failing to receive the output that includes an indication that that the second RF communication signal is received by transceiver device 104 and/or transceiver device 106.

In some non-limiting embodiments, communication detection system 102 may determine whether the second RF communication signal transmitted by HOT unit 220 is received by EOT unit 202 during a time interval after the time at which the first RF communication signal was determined to be received by EOT unit 202. For example, communication detection system 102 may determine that the second RF communication signal was received by EOT unit 202 during the time interval based on an output from transceiver device 104. In another example, communication detection system 102 may determine that the second RF communication signal was not received by EOT unit 202 during the time interval based on communication detection system 102 failing to receive an output from transceiver device 104. In some non-limiting embodiments, communication detection system may determine that the second RF communication signal is not received by EOT unit 202 during the time interval based on communication detection system 102 receiving an indication that the second RF communication signal is not received by EOT unit 202. For example, communication detection system may determine that the second RF communication signal is not received by EOT unit 202 during the time interval based on communication detection system 102 receiving the indication that the second RF communication signal was not received by EOT unit 202 from transceiver device 104.

In some non-limiting embodiments, communication detection system 102 may determine whether a second RF communication signal transmitted by EOT unit 202 is received by HOT unit 220 during a time interval after the time at which the first RF communication signal was determined to be received by HOT unit 220. For example, communication detection system 102 may determine that the second RF communication signal is received by HOT unit 220 during the time interval based on an output from transceiver device 106. In another example, communication detection system 102 may determine that the second RF communication signal is not received by HOT unit 220 during the time interval based on communication detection system 102 failing to receive an output from transceiver device 106. In some non-limiting embodiments, communication detection system 102 may determine that the second RF communication signal is not received by HOT unit 220 during the time interval based on communication detection system 102 receiving an indication that the second RF communication signal is not received by HOT unit 220. For example, communication detection system 102 may determine that the second RF communication signal is not received by HOT unit 220 during the time interval based on communication detection system 102 receiving the indication that the second RF communication signal was not received by HOT unit 220 from transceiver device 106.

In some non-limiting embodiments, communication detection system 102 may determine whether the second RF communication signal is received during the time interval after the first RF communication signal was received based on a time counter. For example, communication detection system 102 may determine the time at which the first RF communication signal was determined to be received by EOT unit 202 or HOT unit 220. Communication detection system 102 may initiate the time counter after the time at which the first RF communication signal was determined to be received by EOT unit 202 or HOT unit 220. Communication detection system 102 may determine whether the second RF communication signal is received before the time counter expires.

In some non-limiting embodiments, communication detection system 102 may determine that the second RF communication signal is not received during the time interval and communication detection system 102 may determine a time for which the second RF communication signal was not received. For example, communication detection system 102 may determine that the second RF communication signal is not received during the time interval and communication detection system 102 may determine a time (e.g., a time of day) at which the time interval expires. Communication detection system 102 may determine that the time at which the time interval expires is the time for which the second RF communication signal was not received. In some non-limiting embodiments, communication detection system 102 may store the time for which the second RF communication signal was not received. For example, communication detection system 102 may store data associated with the time for which the second RF communication signal was not received in a data structure (e.g., a data structure of a memory device, such as memory 206 or memory 226), during a predetermined time interval (e.g., an hour). In some non-limiting embodiments, the predetermined time interval may be a predetermined time interval from the time for which the second RF communication signal was not received.

As further shown in FIG. 4, at step 406 ("Yes"), process 400 includes foregoing determining a location of one or more rail vehicles. For example, communication detection system 102 may forego determining the location of one or more rail vehicles (e.g., first rail vehicle 201 or second rail vehicle 219), one or more rail vehicles of a plurality of rail vehicles, and/or a plurality of rail vehicles. In some non-limiting embodiments, communication detection system 102 may forego determining the location of the one or more rail vehicles based on determining that the second RF communication signal is received during a time interval after the first RF communication signal was received. For example, communication detection system 102 may forego determining the location of the one or more rail vehicles based on determining that the second RF communication signal is received by EOT unit 202 during a time interval after a time at which the first RF communication signal was determined to be received by EOT unit 202. In another example, communication detection system 102 may forego determining the location of the one or more rail vehicles based on determining that the second RF communication signal is received by HOT unit 220 during a time interval after a time at which the first RF communication signal was determined to be received by HOT unit 220.

As further shown in FIG. 4, at step 408 ("No"), process 400 includes determining a location of one or more rail vehicles. For example, communication detection system 102 may determine the location of one or more rail vehicles (e.g., first rail vehicle 201 or second rail vehicle 219), one or more rail vehicles of a plurality of rail vehicles, and/or a plurality of rail vehicles. In some non-limiting embodiments, communication detection system 102 may determine the location of the one or more rail vehicles based on location data (e.g., location coordinates, satellite-based position system coordinates, GPS coordinates, and/or the like) associated with the location of the one or more rail vehicles received from a satellite-based position system. For example, communication detection system 102 may determine the location of the one or more rail vehicles based on GPS location data associated with the location of the one or more rail vehicles received from the GPS system. In some non-limiting embodiments, communication detection system 102 may determine one or more locations of one or more rail vehicles (e.g., a plurality of locations of one or more rail vehicles, an aggregate of locations of one or more rail vehicles, and/or the like).

In some non-limiting embodiments, communication detection system 102 may determine location data associated with one or more locations of the one or more rail vehicles. For example, communication detection system 102 may determine the location data associated with the one or more locations of the one or more rail vehicles based on a satellite-based position system. In some non-limiting embodiments, communication detection system 102 may determine the location data associated with the one or more locations of the one or more rail vehicles by retrieving the location data received from a data structure (e.g., a data structure associated with satellite-based position system stored on a rail vehicle). In some non-limiting embodiments, the one or more locations of the plurality of rail vehicles may include one or more locations on a railway that the plurality of rail vehicles traveled during the time interval after the first RF communication signal was received. In some non-limiting embodiments, the one or more locations of the plurality of rail vehicles may include a plurality of locations on a railway that the plurality of rail vehicles traveled between initiating a time counter and stopping the time counter.

In some non-limiting embodiments, the location of one or more rail vehicles may be associated with a location of the one or more rail vehicles where the second RF communication signal is not received by EOT unit 202 during a time interval after the first RF communication signal was determined to be received by EOT unit 202. For example, the location of the one or more rail vehicles may be the location of the one or more rail vehicles (e.g., one or more rail vehicles on which EOT unit 202 and HOT unit 220 are positioned) where the second RF communication signal transmitted by HOT unit 220 is not received by EOT unit 202 during the time interval after a time at which the first RF communication signal was determined to be received by EOT unit 202.

In some non-limiting embodiments, the location of one or more rail vehicles may be associated with one or more locations of one or more rail vehicles where the second RF communication signal is not received by HOT unit 220 during a time interval after the first RF communication signal was determined to be received by HOT unit 220. For example, the one or more locations of the one or more rail vehicles may be one or more locations of the one or more rail vehicles (e.g., one or more rail vehicles on which EOT unit 202 and HOT unit 220 are positioned) where the second RF communication signal transmitted by EOT unit 202 is not received by HOT unit 220 during the time interval after a time at which the first RF communication signal was determined to be received by HOT unit 220.

In some non-limiting embodiments, communication detection system 102 may determine the location of the one or more rail vehicles based on determining that the second RF communication signal is not received during the time interval. For example, communication detection system 102 may determine the location of the one or more rail vehicles based on determining that the second RF communication signal transmitted by HOT unit 220 is not received by EOT unit 202 during the time interval. In another example, communication detection system 102 may determine the location of the one or more rail vehicles based on determining that the second RF communication signal transmitted by EOT unit 202 is not received by HOT unit 220 during the time interval. In some non-limiting embodiments, communication detection system 102 may determine the location of the one or more rail vehicles based on a time at which the time interval expires. For example, communication detection system 102 may determine the location of the one or more rail vehicles at the time at which the time interval expires. In another example, communication detection system 102 may determine the location of the one or more rail vehicles at a time after which the time interval expires. In some non-limiting embodiments, communication detection system 102 may determine the location of the one or more rail vehicles during the time interval based on determining that the time interval expires.

In some non-limiting embodiments, communication detection system 102 may transmit location data associated with one or more locations of the one or more rail vehicles based on determining the location of the one or more rail vehicles. For example, communication detection system 102 may transmit the location data to back office system 228 that is remote from communication detection system 102 based on determining the location of the one or more rail vehicles. In some non-limiting embodiments, communication detection system 102 may transmit location data to back office system 228 based on determining that the second RF communication signal is not received during the time interval.

Figure 7:
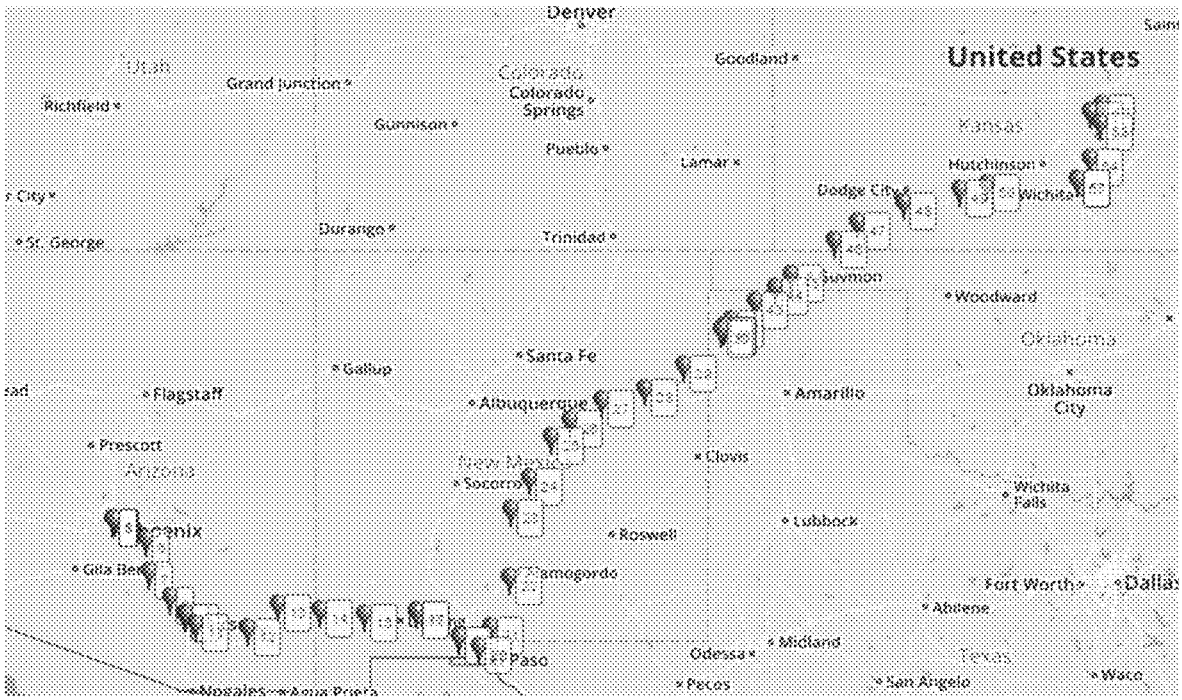
FIG. 7 is a non-limiting embodiment of a map generated based on location data associated with one or more locations of one or more rail vehicles traveled by the one or more rail vehicles when a radio frequency (RF) communication signal was not received between a plurality of rail vehicles.

In some non-limiting embodiments, back office system 228 and/or communication detection system may generate a map of one or more locations of the one or more rail vehicles based on location data associated with one or more locations of the one or more rail vehicles. For example, communication detection system 102 may determine location data associated with the one or more locations of the one or more rail vehicles based on determining that the second RF communication signal is not received during the time interval after which the first RF communication signal was received. Communication detection system 102 may transmit the location data associated with the one or more locations of the one or more rail vehicles to back office system 228. In some non-limiting embodiments, back office system 228 may generate the map of one or more locations of the one or more rail vehicles (e.g., one or more locations of the one or more rail vehicles where the second RF communication signal is not received during the time interval after the first RF communication signal was received) based on the location data. In some non-limiting embodiments, the map may be generated based on location data associated with one or more locations of one or more rail vehicles traveled by the one or more rail vehicles when an RF communication signal was not received between a plurality of rail vehicles that includes the one or more rail vehicles. As an example, referring now to FIG. 7, FIG. 7 is a non-limiting embodiment of map 700 generated based on location data associated with one or more locations of one or more rail vehicles traveled by the one or more rail vehicles when an RF communication signal was not received between a plurality of rail vehicles.

In some non-limiting embodiments, communication detection system 102 may transmit the location data associated with one or more locations of the one or more rail vehicles based on a predetermined time interval. For example, communication detection system 102 may determine the location data associated with the location of the one or more rail vehicles during a predetermined time interval (e.g., an hour) and communication detection system 102 may transmit the location data when the predetermined time interval expires. In some non-limiting embodiments, communication detection system 102 may transmit the location data associated with one or more locations of the one or more rail vehicles based on determining the location data associated with the one or more locations of the plurality of rail vehicles.

In some non-limiting embodiments, communication detection system 102 may store the location data associated with the location of the one or more rail vehicles. For example, communication detection system 102 may store the location data in a data structure (e.g., a data structure of a memory device, such as memory 206 or memory 226) associated with communication detection system 102 based on determining the location of the one or more rail vehicles. In some non-limiting embodiments, communication detection system 102 may assign additional data associated with the one or more rail vehicles to the location data. For example, communication detection system 102 may assign a time stamp (e.g., a time stamp including a time of day, a time stamp including a date, a time stamp including a time of day and a date, and/or the like), an alert type (e.g., an alert type associated with a report for an RF communication signal not being received), an address (e.g., an address associated with a state, an address associated with a city, an address associated with a state and a city, and/or the like), a firmware version (e.g., a firmware version associated with EOT unit 202, a firmware version associated with HOT unit 220, and/or the like), a battery measurement (e.g., a voltage measurement of a battery of EOT unit 202, a voltage measurement of a battery of HOT unit 220, and/or the like), an EOT status, and/or an HOT status to the location data. In some non-limiting embodiments, communication detection system 102 may store the location data based on assigning the additional data to the location data. As an example, referring now to FIG. 6A, FIG. 6A is a diagram of a non-limiting embodiment of data structure 600 including data associated with one or more rail vehicles assigned to location data associated with a plurality of locations of the one or more rail vehicles. In some non-limiting embodiments, EOT unit 202 may store data structure 600 locally (e.g., in memory 206). As another example, referring now to FIG. 6B, FIG. 6B is a diagram of a non-limiting embodiment of data structure 602 including data associated with one or more rail vehicles assigned to location data associated with a plurality of locations of the one or more rail vehicles. In some non-limiting embodiments, HOT unit 220 may store data structure 602 locally (e.g., in memory 226).

In some non-limiting embodiments, communication detection system 102 may determine a time at which the first RF communication signal was determined to be received (e.g., by EOT unit 202 or by HOT unit 220). Communication detection system 102 may initiate a time counter after the time at which the first RF communication signal was determined to be received and communication detection system 102 may determine that the second RF communication signal is not received (e.g., by EOT unit 202 or by HOT unit 220) during a time interval after the first RF communication signal was received. Communication detection system 102 may stop the time counter at a time at which a third RF communication signal (e.g., an RF communication that is the same or similar to the first RF communication signal or the second RF communication signal) is determined to be received (e.g., by EOT unit 202 or by HOT unit 220). In some non-limiting embodiments, communication detection system 102 may determine one or more locations of the one or more rail vehicles between when the time counter was initiated and when the time counter was stopped.

Figure 5A:
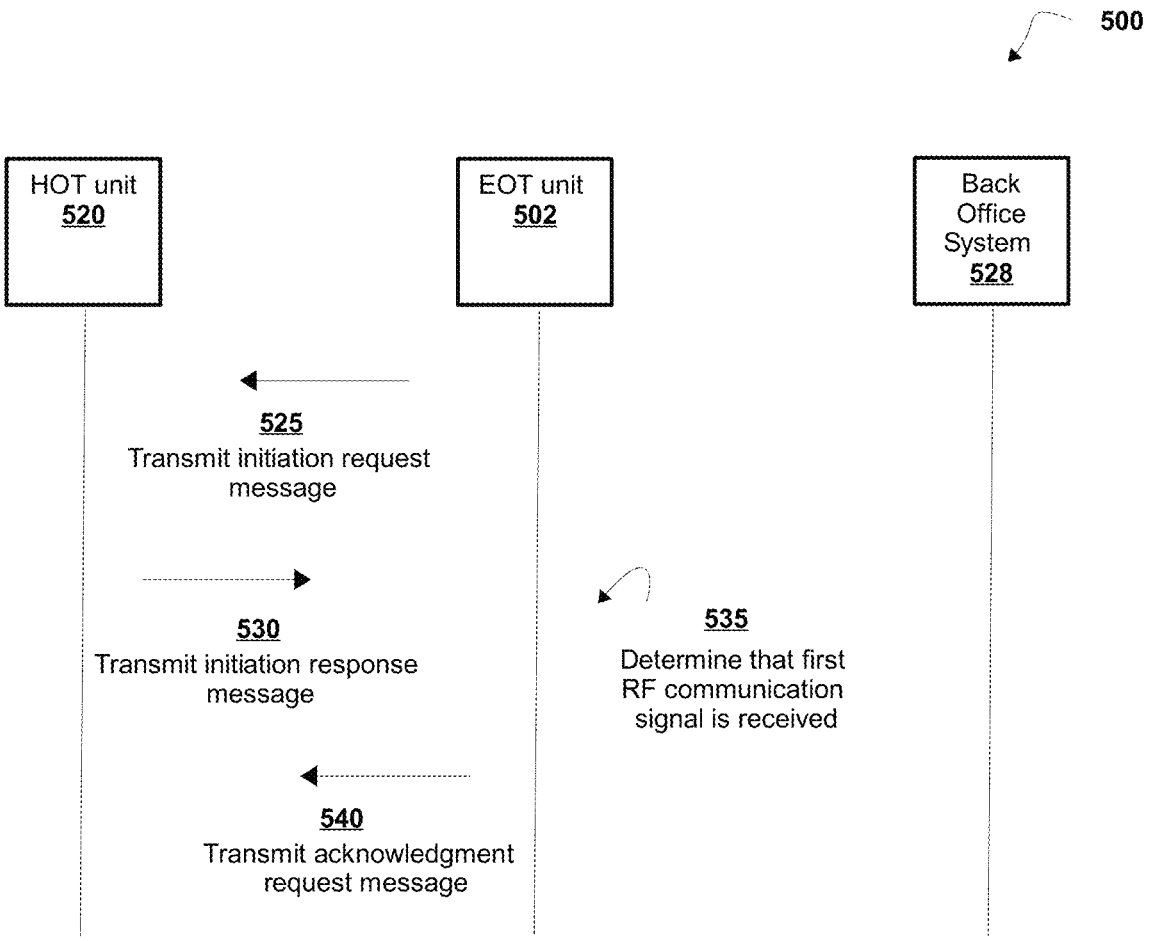
FIGS. 5A-5B are diagrams of an implementation of a non-limiting embodiment of a process disclosed herein.
Figure 5B:
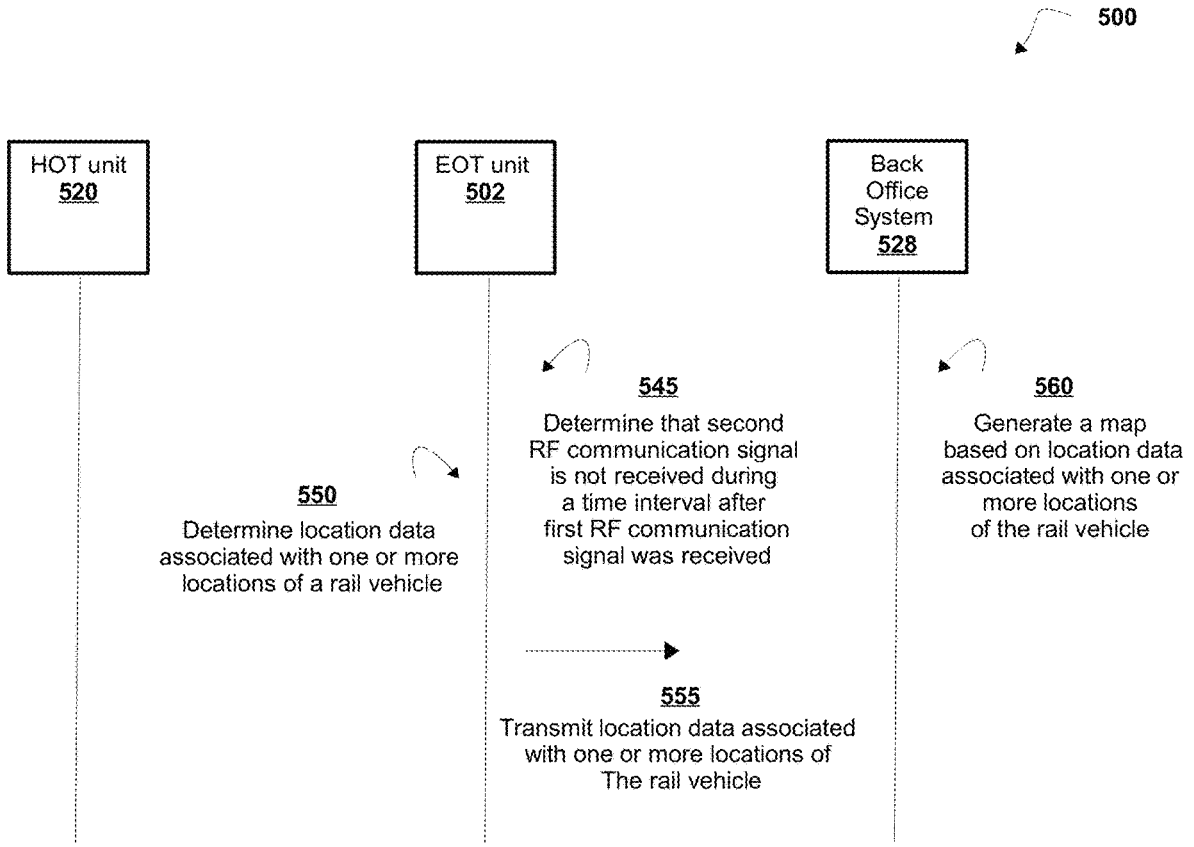

Referring now to FIGS. 5A-5B, FIGS. 5A-5B are a diagram of an overview of a non-limiting embodiment of implementation 500 relating to a process for determining loss of a communication between rail vehicles. As shown in FIGS. 5A-5B, implementation 500 may include EOT unit 502, HOT unit 520, and back office system 528. In some non-limiting embodiments, EOT unit 502 may be the same or similar to EOT unit 202, HOT unit 520 be the same or similar to HOT unit 220, and back office system 528 may be the same or similar to back office system 228. In some non-limiting embodiments, EOT unit 502 may be positioned on a first rail vehicle (e.g., a trailing rail vehicle) of a plurality of rail vehicles and HOT unit 520 may be positioned on a second rail vehicle (e.g., a lead rail vehicle) of the plurality of rail vehicles.

As shown by reference number 525 in FIG. 5A, EOT unit 502 may transmit an initiation request message for a communication connection between EOT unit 502 and HOT unit 520. As further shown by reference number 530 in FIG. 5, HOT unit 520 may transmit an initiation response message to EOT unit 502. For example, HOT unit 520 may receive the initiation request message and HOT unit 520 transmit the initiation response message to EOT unit 502 based on receiving the initiation request message. In some non-limiting embodiments, an RF communication connection may be established between EOT unit 502 and HOT unit 520 (e.g., HOT unit 520 may be armed to EOT unit 502) based on EOT unit 502 receiving the initiation response message from HOT unit 520. In some non-limiting embodiments, an RF communication connection may be established between EOT unit 502 and HOT unit 520 (e.g., HOT unit 520 may be armed to EOT unit 502) based on HOT unit 520 receiving the initiation request message from EOT unit 502.

As further shown by reference number 535 in FIG. 5A, EOT unit 502 may determine whether a first RF communication signal is received by EOT unit 502. For example, EOT unit 502 may receive the initiation response message as a first RF communication signal and EOT unit 502 may determine that the first RF communication signal is received by EOT unit 502. As further shown by reference number 540 is FIG. 5A, EOT unit 502 may transmit an acknowledgment request message to HOT unit 520. In some non-limiting embodiments, EOT unit 502 may monitor the RF communication connection between HOT unit 520 and EOT unit 502 to determine whether a second RF communication signal is received during a time interval after the first RF communication signal is received. For example, EOT unit 502 may determine whether a second RF communication signal (e.g., a second RF communication signal transmitted by HOT unit 520) is received by EOT unit 502 during a time interval after a time at which the first RF communication signal was determined to be received by EOT unit 502.

As shown by reference number 545 in FIG. 5B, EOT unit 502 may determine that a second RF communication signal (e.g., a second RF communication signal transmitted by HOT unit 520) is not received by EOT unit 502 during a time interval after the first RF communication signal was received by EOT unit 502. For example, EOT unit 502 may determine that the second RF communication signal transmitted by HOT unit 520 is not received by EOT unit 502 during the time interval after a time at which the first RF communication signal was determined to be received by EOT unit 502.

As further shown by reference number 550 in FIG. 5B, EOT unit 502 may determine location data associated with one or more locations of a rail vehicle based on determining that a second RF communication signal transmitted by HOT unit 520 is not received by EOT unit 502 during the time interval after the first RF communication signal was received. For example, EOT unit 502 may determine location data associated with one or more locations of the rail vehicle on which EOT unit 502 is positioned. As further shown by reference number 555 in FIG. 5B, EOT unit 502 may transmit the location data associated with one or more locations of the rail vehicle to back office system 528. As further shown by reference number 560 in FIG. 5B, back office system 528 may receive the location data and back office system 528 may generate a map based on the location data associated with the one or more locations of the rail vehicle.

Some non-limiting embodiments are described herein in connection with thresholds (e.g., threshold values). As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, and/or the like.

The foregoing disclosure provides illustration and description, but is not intended to be exhaustive or to limit the implementations to the precise form disclosed. Modifications and variations are possible in light of the above disclosure or may be acquired from practice of the implementations.

It will be apparent that systems, devices, products, apparatus, and/or methods, described herein, may be implemented in different forms of hardware or a combination of hardware and software. The actual specialized control hardware or software code used to implement these systems, devices, products, apparatus, and/or methods is not limiting of the implementations. Thus, the operation and behavior of the systems and/or methods were described herein without reference to specific software code—it being understood that software and hardware can be designed to implement the systems, devices, products, apparatus, and/or methods based on the description herein.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

What is claimed is:

1. A system for determining loss of a communication between rail vehicles, comprising:

at least one processor programmed or configured to:

determine that a first radio frequency (RF) communication signal transmitted by a head of train (HOT) unit of a plurality of rail vehicles is received by an end of train (EOT) unit of the plurality of rail vehicles;

determine whether a second RF communication signal transmitted by the HOT unit is received by the EOT unit during a time interval after a time at which the first RF communication signal was determined to be received by the EOT unit; and determine one or more locations of the plurality of rail vehicles based on determining that the second RF communication signal transmitted by the HOT unit is not received by the EOT unit during the time interval.

2. The system of claim 1, wherein the time interval has a range between 0.6 seconds to four minutes.

3. The system of claim 1, wherein the at least one processor is a component of the EOT unit.

4. The system of claim 1, wherein the at least one processor is further programmed or configured to:

determine the time at which the first RF communication signal was determined to be received by the EOT unit;

initiate a time counter after the time at which the first RF communication signal was determined to be received by the EOT unit; and stop the time counter at a time at which a third RF communication signal was determined to be received by the EOT unit.

5. The system of claim 4, wherein, when determining the one or more locations of the plurality of rail vehicles, the at least one processor is programmed or configured to:

determine location coordinates of the one or more locations of the plurality of rail vehicles, wherein the one or more locations of the plurality of rail vehicles include a plurality of locations on a railway that the plurality of rail vehicles traveled between initiating the time counter and stopping the time counter.

6. The system of claim 1, wherein, when determining the one or more locations of the plurality of rail vehicles, the at least one processor is programmed or configured to:

determine location coordinates of the one or more locations of the plurality of rail vehicles, wherein the one or more locations of the plurality of rail vehicles include one or more locations on a railway that the plurality of rail vehicles traveled during the time interval.

7. The system of claim 1, wherein the at least one processor is further programmed or configured to:

determine location data associated with the one or more locations of the plurality of rail vehicles based on determining the one or more locations; and store the location data associated with the one or more locations of the plurality of rail vehicles in a data structure.

8. A method for determining loss of a communication between rail vehicles, comprising:

determining, with at least one processor of an end of train (EOT) unit, that a first radio frequency (RF) communication signal transmitted by a head of train (HOT) unit of a plurality of rail vehicles is received by the EOT unit of the plurality of rail vehicles;

determining, with at least one processor of the EOT unit, whether a second RF communication signal transmitted by the HOT unit is received by the EOT unit during a time interval after the first RF communication signal was received by the EOT unit; and determining, with at least one processor of the EOT unit, one or more locations of the plurality of rail vehicles based on determining that the second RF communication signal transmitted by the HOT unit is not received by the EOT unit during the time interval.

9. The method of claim 8, wherein the time interval has a range between 0.6 seconds to four minutes.

10. The method of claim 8, further comprising:

determining a time at which the first RF communication signal was received by the EOT unit;

initiating a time counter after the time at which the first RF communication signal was determined to be received by the EOT unit; and stopping the time counter at a time at which a third RF communication signal was determined to be received by the EOT unit.

11. The method of claim 10, wherein determining the one or more locations of the plurality of rail vehicles comprises:

determining location coordinates of the one or more locations of the plurality of rail vehicles, wherein the one or more locations of the plurality of rail vehicles include a plurality of locations on a railway that the plurality of rail vehicles traveled between initiating the time counter and stopping the time counter.

12. The method of claim 8, wherein determining the one or more locations of the plurality of rail vehicles comprises:

determining location coordinates of the one or more locations of the plurality of rail vehicles, wherein the one or more locations of the plurality of rail vehicles include one or more locations on a railway that the plurality of rail vehicles traveled during the time interval.

13. The method of claim 8, further comprising:

determining location data associated with the one or more locations of the plurality of rail vehicles based on determining the one or more locations; and storing the location data associated with the one or more locations of the plurality of rail vehicles in a data structure.

14. The method of claim 13, further comprising:

transmitting location data associated with the one or more locations of the plurality of rail vehicles to a back office system based on determining that the second RF communication signal transmitted by the HOT unit is not received by the EOT unit during the time interval.

15. A computer program product for determining loss of a communication between rail vehicles, the computer program product comprising at least one non-transitory computer-readable medium including one or more instructions that, when executed by at least one processor, cause the at least one processor to:

determine that a first radio frequency (RF) communication signal transmitted by a head of train (HOT) unit of a plurality of rail vehicles is received by an end of train (EOT) unit of the plurality of rail vehicles;

determine whether a second RF communication signal transmitted by the HOT unit is received by the EOT unit during a time interval after a time at which the first RF communication signal was determined to be received by the EOT unit; and determine one or more locations of the plurality of rail vehicles based on determining that the second RF communication signal transmitted by the HOT unit is not received by the EOT unit during the time interval.

16. The computer program product of claim 15, wherein the time interval has a range between 0.6 seconds to four minutes.

17. The computer program product of claim 15, wherein the one or more instructions further cause the at least one processor to:

determine the time at which the first RF communication signal was determined to be received by the EOT unit;

initiate a time counter after the time at which the first RF communication signal was determined to be received by the EOT unit; and stop the time counter at a time at which a third RF communication signal was determined to be received by the EOT unit.

18. The computer program product of claim 17, wherein the one or more instructions that cause the at least one processor to determine the one or more locations of the plurality of rail vehicles, cause the at least one processor to:

determine location coordinates of the one or more locations of the plurality of rail vehicles, wherein the one or more locations of the plurality of rail vehicles include a plurality of locations on a railway that the plurality of rail vehicles traveled between initiating the time counter and stopping the time counter.

19. The computer program product of claim 15, wherein the one or more instructions that cause the at least one processor to determine the one or more locations of the plurality of rail vehicles, cause the at least one processor to:

determine location coordinates of the one or more locations of the plurality of rail vehicles, wherein the one or more locations of the plurality of rail vehicles include one or more locations on a railway that the plurality of rail vehicles traveled during the time interval.

20. The computer program product of claim 19, wherein the one or more instructions further cause the at least one processor to:

determine location data associated with the one or more locations of the plurality of rail vehicles based on determining the one or more locations; and transmit the location data associated with the one or more locations of the plurality of rail vehicles based on determining location data associated with the one or more locations of the plurality of rail vehicles.

* * * * *